US005393268A

United States Patent [19]

Cunard et al.

[11] Patent Number: 5,393,268

[45] Date of Patent: Feb. 28, 1995

[54] TANDEM SWING

[75] Inventors: Joel C. Cunard; Robert J. Boudreau, both of Bedford, Pa.

[73] Assignee: Hedstrom Corporation, Bedford, Pa.

[21] Appl. No.: 30,667

[22] Filed: Mar. 12, 1993

[51] Int. Cl.[6] ..... A63G 9/00

[52] U.S. Cl. ..... 472/120; 472/118

[58] Field of Search ..... 472/118-125, 472/108, 111, 112; 297/244

[56] References Cited

U.S. PATENT DOCUMENTS

| | | | |
|---|---|---|---|
| 2,533,482 | 12/1950 | Liesner | 472/120 |
| 3,145,013 | 8/1964 | Grudoski | 472/118 |
| 3,391,932 | 7/1968 | Scalf | 472/120 |
| 3,447,802 | 6/1969 | Grudoski | 472/120 |
| 3,782,724 | 1/1974 | Rottman et al. | 273/55 D |
| 4,155,548 | 5/1979 | Smith et al. | 472/120 |

*Primary Examiner*—Carl D. Friedman
*Assistant Examiner*—Kien Nguyen
*Attorney, Agent, or Firm*—Cesari and McKenna

[57] ABSTRACT

A children's swing has an elongated beam with opposite ends and a mid portion providing a seating platform for at least two children. Pivotally attached to the opposite ends of the beam are a pair of rigid rockers, each rocker having an upper end defining hand grips and a lower end defining a foot rest. To use the rocker, the children sit on the beam back to back with their hands and feet on the hand grips and foot rests of the rockers in front of them. When the children rock the rockers in synchronism, the swing will swing to and fro with ever increasing amplitude due to the inertia of the children's limbs and changes in the included angles between the rockers and the beam.

8 Claims, 3 Drawing Sheets

TANDEM SWING

FIELD OF THE INVENTION

This invention relates to a children's swing. It relates more particularly to a swing which can be used by two children simultaneously.

BACKGROUND OF THE INVENTION

Children's swings are usually supported above the ground by an overhead support, such as the crossbar of a play gym. The most common type of swing is a simple seat which is suspended frown the overhead support by a pair of ropes or chains. That type of swing is usually used by a single rider, although it has been known for two children to stand on a swing facing each other and to propel the swing by shifting their weights in unison.

There is also a swing called a glide ride which is composed of a pair of rigid parallel hangers which hang down from the overhead support. A beam is pivotally connected at its midpoint to the lower ends of the hangers and seats are formed at the opposite ends of the beam to support two children. When the children shift their weights in unison, the beam swings to and fro while remaining more or less parallel to the ground.

Both of the above types of swings are disadvantaged in that they have no parts with which a child can interact to effect the motion of the swing. In other words, there is nothing for the children to do except to hold on to the ropes or hangers supporting the swing seats.

SUMMARY OF THE INVENTION

Accordingly, it is an object of the present invention to provide a children's swing which can be used by two children simultaneously.

Another object of the invention is to provide a swing of this type on which two children can sit facing away from each other and independently control the movement of the swing.

Yet another object of the invention is to provide a tandem swing which can be assembled by the purchaser without any special tools or fixtures.

Yet another object of the invention is to provide such a swing which is easy and safe to use.

Other object of the invention will, in part, be obvious and will, in part, appear hereinafter.

The invention accordingly, comprises the features of construction, combination of elements and arrangement of parts which will be exemplified in the construction hereinafter set forth and the scope of the invention will be indicated in the claims.

Briefly, my children's swing includes a relatively long rigid beam and two panel-like rockers pivotally connected to the opposite ends of the beam such that the nominal planes of the rockers are more or less perpendicular to the longitudinal axis of the beam. The beam provides seats for two children facing away from each other and toward the rockers and the rockers are configured to provide hand grips and foot supports for those children. The two rockers are suspended from an overhead support by chains or other suitable means so that the swing can swing to and fro, i.e., in the general direction of the beam axis.

To operate the swing, the two children rock or pivot their respective rockers with respect to the beam in unison by pushing or pulling on the tops of the panels with their hands while pulling or pushing on the bottoms of the rockers with their feet. The pivoting motion of each rocker changes the angle that the chains supporting that rocker make with the overhead support, and also changes the elevation of that end of the beam. Thus, each rider, by manipulating a rocker and shifting his or her weight can affect the motion of the swing. The two riders can choose to synchronize their motions and thus apply a maximum impulse to the swing so that it operates in resonance. Alternatively, one of the riders can operate the corresponding rocker so as to interfere with or obstruct the swinging motion being encouraged by the other rider. Thus, a variety of different swinging actions may be achieved to hold the children's interests.

The swing itself is composed for the most part of molded plastic parts which are rugged, reliable and resistant to the weather. Special pivotal connections to be described in more detail later connect the opposite ends of the beam to the two rockers so as to maximize the strength of the swing at those locations and to limit the excursions of the rockers relative to the beam for safety reasons. The swing can be shipped in a knocked-down condition and assembled by the purchaser without any special tools or equipment. For all of these reasons, the swing should find wide acceptance in the marketplace.

BRIEF DESCRIPTION OF THE DRAWINGS

For a fuller understanding of the nature and objects of the invention, reference should be had to the following detailed description, taken in connection with the accompanying drawings, in which.

DETAILED DESCRIPTION OF ILLUSTRATIVE EMBODIMENT

Figure 1:
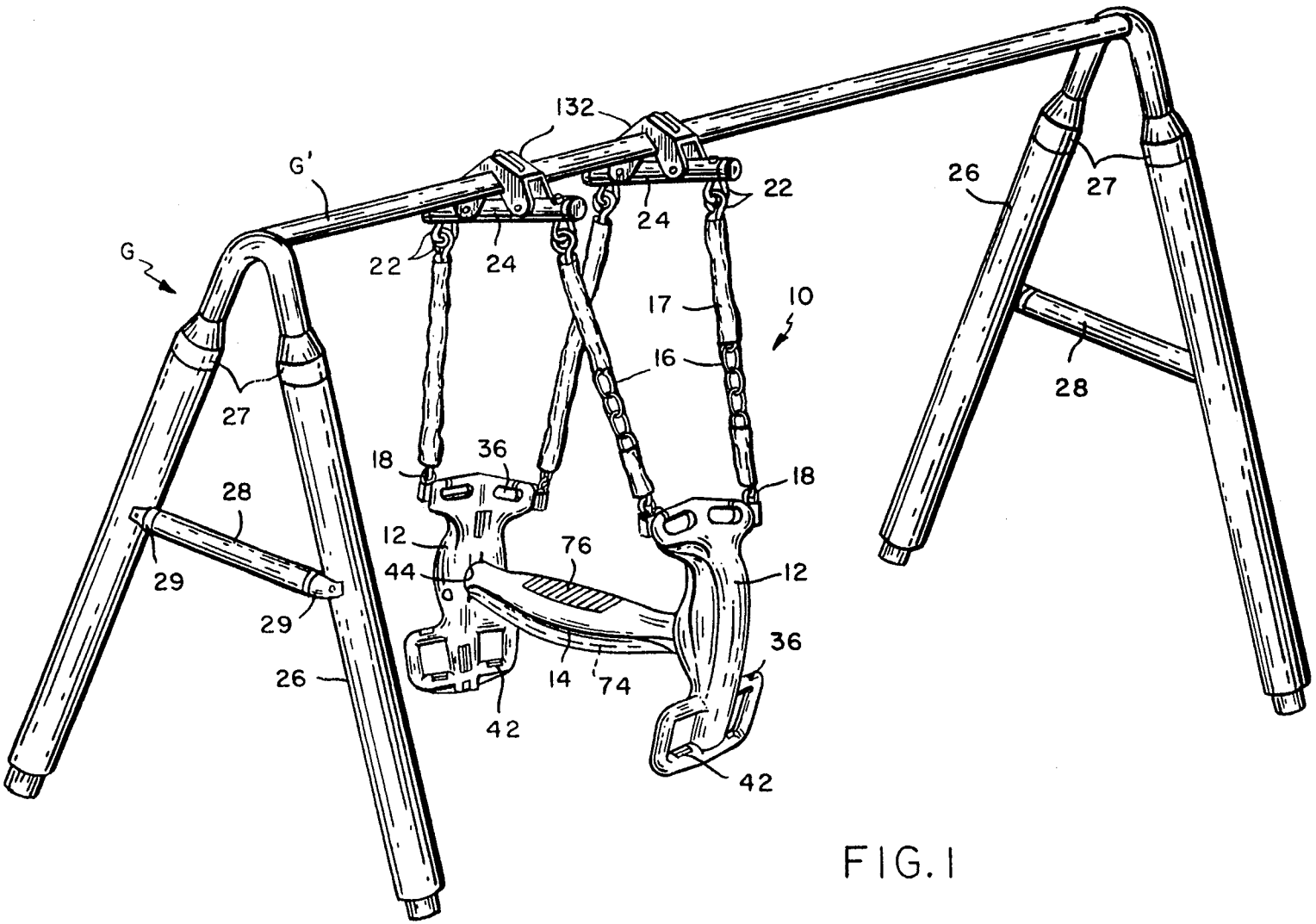
FIG. 1 is an isometric view of a tandem swing incorporating the invention.

Referring to FIG. 1 of the drawing, the subject swing, shown generally at 10, is suspended from an overhead support such as the crossbar G' of a conventional A-frame play gym G. Swing 10 includes a pair of mirror image rigid rockers 12 each being about 2 feet long, pivotally connected at their mid points to the opposite ends of a relatively long, e.g., 32 inches, rigid beam 14. Each rocker 12 is supported by a pair of chains 16, each being about 4 feet long, the lower ends of the chains being linked to eye bolts 18 present at the upper corners of each rocker. The chains may be covered by plastic sheaths 17. The upper ends of the two chains 16 from each rocker 12 are connected via conventional links 22 to corresponding first ends of a pair of relatively short, e.g., 16 inches, pipes 24 or channels 24' (FIG. 4 in phantom) clamped crosswise to the crossbar G'. The similar pair of chains 16 extending up from the other rocker 12 are likewise linked to the opposite ends of those same pipes.

Figure 4:
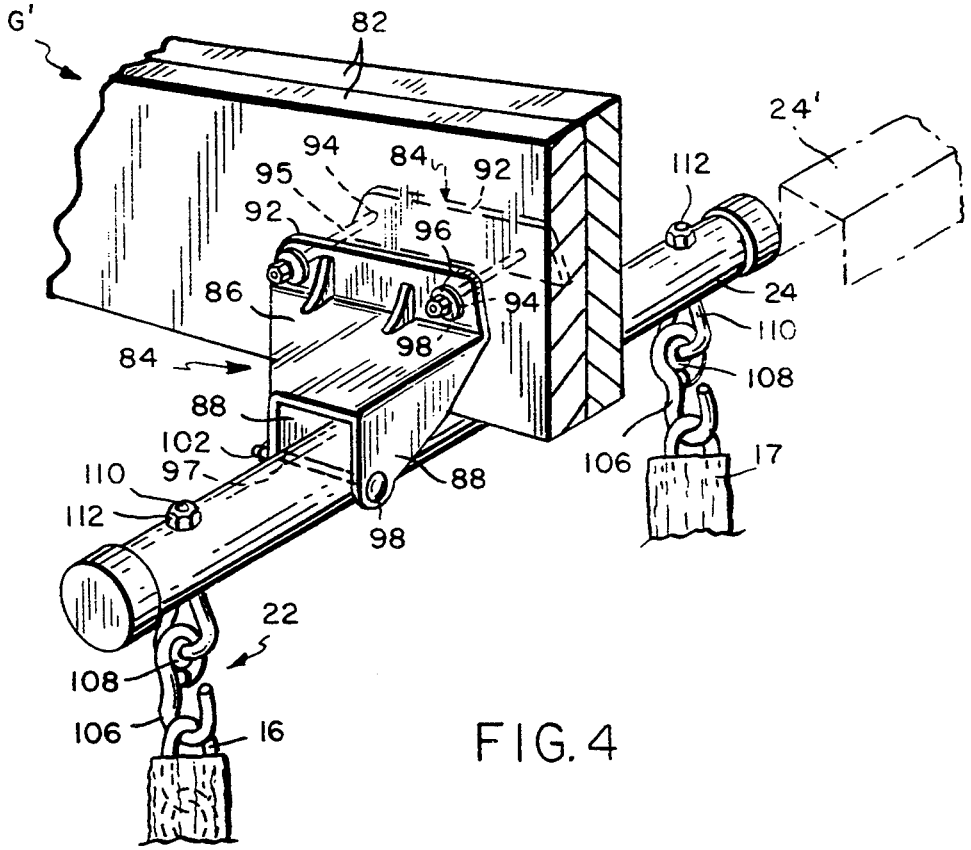
FIG. 4 is a fragmentary isometric view showing the connection of the swing to a wood plank support.

The links 22 between the chains 16 and the pipes 24 may consist of conventional S-hooks and eye bolts with or without nylon bearings as is well known in the art; see FIG. 4. Also, the two pipes 24 are spaced along the crossbar G' a distance which is more or less equal to the widths of rockers 12, e.g., about 14 inches. Thus, when swing 10 is at rest, the beam 14 is more or less horizontal and the rockers and chains 16 converge toward the pipes 24. That is, the longitudinal axis of each rocker makes an acute angle with the longitudinal axis of the beam 14.

Preferably, the legs of the play gym G are covered by plastic foam sheaths 26 terminated by tubular plastic end caps 27. Similar sheaths 28 and end caps 29 are provided on the A-frame cross members of the gym G.

Figure 2:
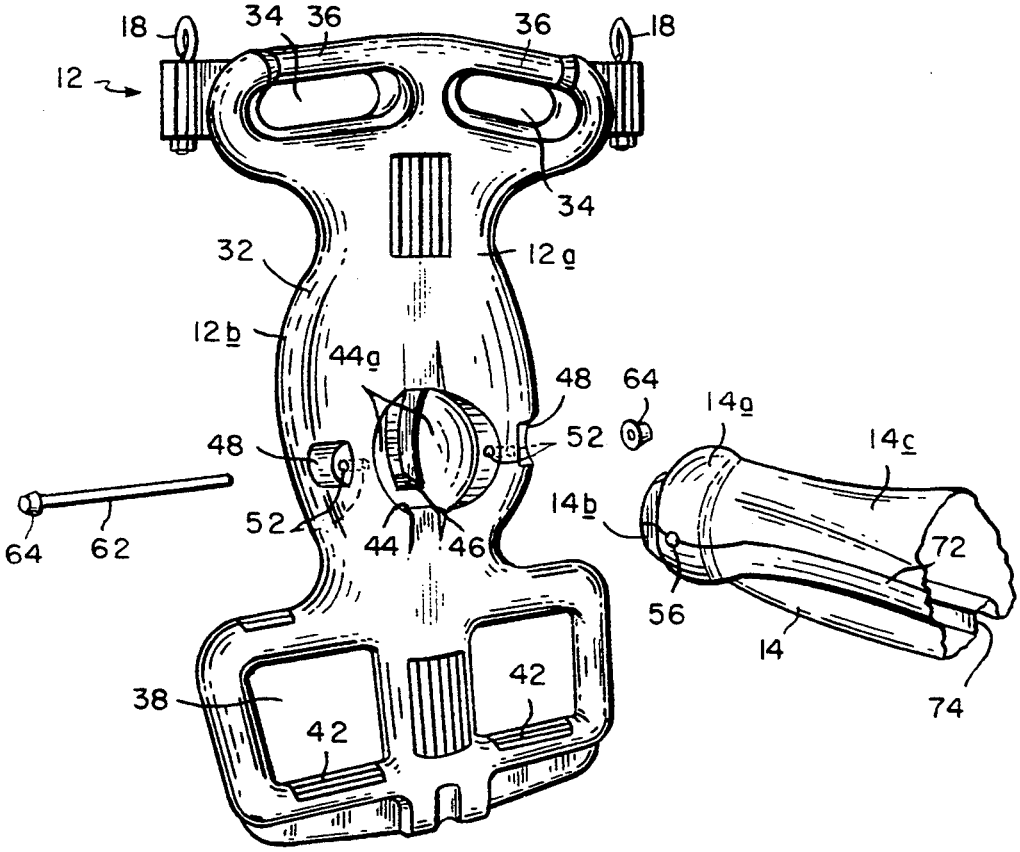
FIG. 2 is an exploded isometric view showing portions of the swing in greater detail.

Referring now to FIG. 2, each rocker 12 is composed of a pair of inner and outer molded plastic shell-like panels 12*a* and 12*b* which are welded together at their edges by welds 32 to form a strong, rigid, hollow light-weight structure. Each rocker 12 has a relatively wide upper end which is formed with a pair of openings 34 to define a pair of hand grips 36 at the upper end of the rocker. The bottom of the rocker is also relatively wide to accommodate relatively large side-by-side openings 38 that define a pair of foot supports or stirrups 42. With also a fat mid section, each rocker resembles somewhat the front of a motor bike.

Formed in the middle of the inner rocker panel 12*a* is a generally semi-circular recess 44. Present in the wall of that recess is a channel 46 having a generally rectangular cross section and which extends along the longitudinal axis of rocker 12. Thus, hemispherical segments 44*a* of recess 44 exist on each side of channel 46. Formed in the side walls of panel 12*a* are a pair of dimples 48 which are aligned on an axis which extends perpendicular to the longitudinal axis of the rocker and to the direction of channel 46. Present in the bottom walls of those dimples as well as in the wall of recess 44, is a series of holes 52 which are aligned along the transverse axis of the rocker.

The recess 44 in each rocker 12 is arranged to receive a generally hemispherical bulb 14*a* formed at the corresponding end of beam 14. A generally trapezoidal nose 14*b* present at each end of beam 14 is arranged to project into the channel 46 when bulb 14*a* is inserted into recess 44. A pair of lateral holes 56 are provided in the side walls of bulb 14*a* which, when the bulb is inserted into recess 44, is aligned with the holes 52 in rocker 12. To secure the beam to the rocker, a rod 62 is passed through the holes 52 and 56 so that the opposite ends of the rod project into the dimples 48. The rod is secured in place by a pair of locking caps 64 press fit onto the exposed ends of the rod in the two dimples 48.

Figure 3:
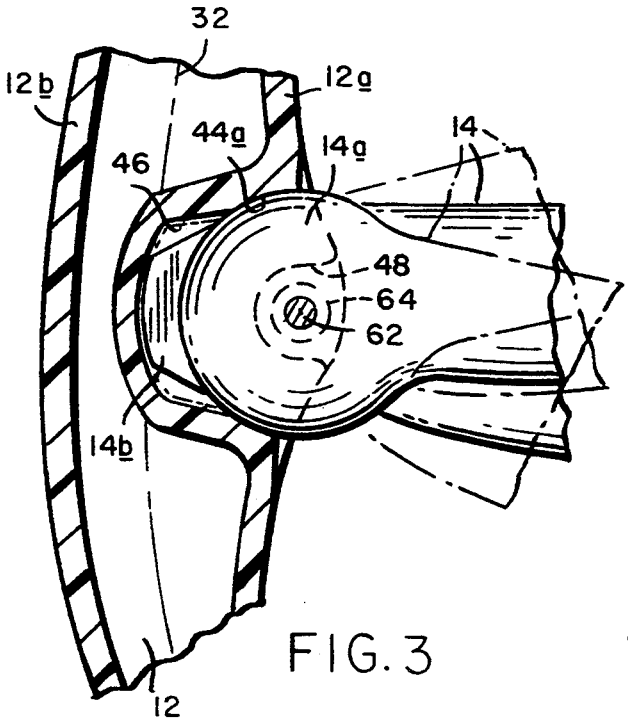
FIG. 3 is a fragmentary elevational view with parts in section showing a rocker hinge connection on the FIG. 1 swing.

As best seen in FIG. 3, the sliding engagement of the beam nose 14*b* in the channel 46 of rocker 12 controls the relative motion of those two members so that the beam cannot rotate about its longitudinal axis relative to the rocker. Also, the rocking excursion of rocker 12 relative to beam 14 is limited by the engagement of nose 14 with the opposite ends of groove 46. Typically, the angular excursion of the rocker 12 is such that the included angle A (FIGS. 6A and 6B) between the longitudinal axis of the rocker and the longitudinal axis of the beam may vary from about 70° to about 130°.

As shown in FIGS. 1 and 2, the beam 14 is a hollow structure composed of upper and lower shells 14*c* and 14*d* which are connected together at their edges by a seam weld 72. A longitudinal channel 74 is formed in the underside of shell 14*d* to rigidify beam 14 and a rippled embossment 76 is present on shell 14*c* to define seat or saddle areas for the two riders.

Referring now to FIG. 4, the pipes 24 that support swing 10 may be mounted to a crossbar G' which consists of one or more wood planks 82, e.g., 2×6's. In this case, each pipe is secured to the underside of the plank(s) by a pair of mirror-image brackets 84. Each bracket comprises a generally trapezoidal main body 86 with a pair of laterally spaced apart ears 88 extending down from the side edges of that body so as to bracket a pipe 24. An integral flange 92 extends along the upper edge of main body 86 with the flange being angled with respect to the main body such that when the ears 88 are more or less perpendicular to pipe 24, flange 92 lies flat against the side of a plank 82. A pair of holes 94 are formed in flange 92 for receiving fasteners to anchor the flange to the plank(s). Thus, in the illustrated arrangement, a bolt 95 extends through each hole 94 and through the planks 82 and through a corresponding hole of the bracket 84 on the opposite side of crossbar G'. A nut 96 is tightened onto the threaded end of each bolt 95 to anchor the bolt in place. Also, a pair of colinear holes 97 are present in ears 88. These holes are aligned with similar holes (not shown) in the opposite walls of pipe 24. A bolt 98 is passed through these holes and secured in place by a nut 102. Thus secured, the two brackets 84 firmly anchor each pipe 24 to the underside of the wood crossbeam G'.

As also seen in FIG. 4, the chains 16 are secured to the opposite ends of each pipe 24 by an S hook 106 whose upper loop contains an annular nylon bearing 108. The hook hooks to an eye bolt 110 which extends up through the pipe and is anchored in place by a nut 112.

Figure 5:
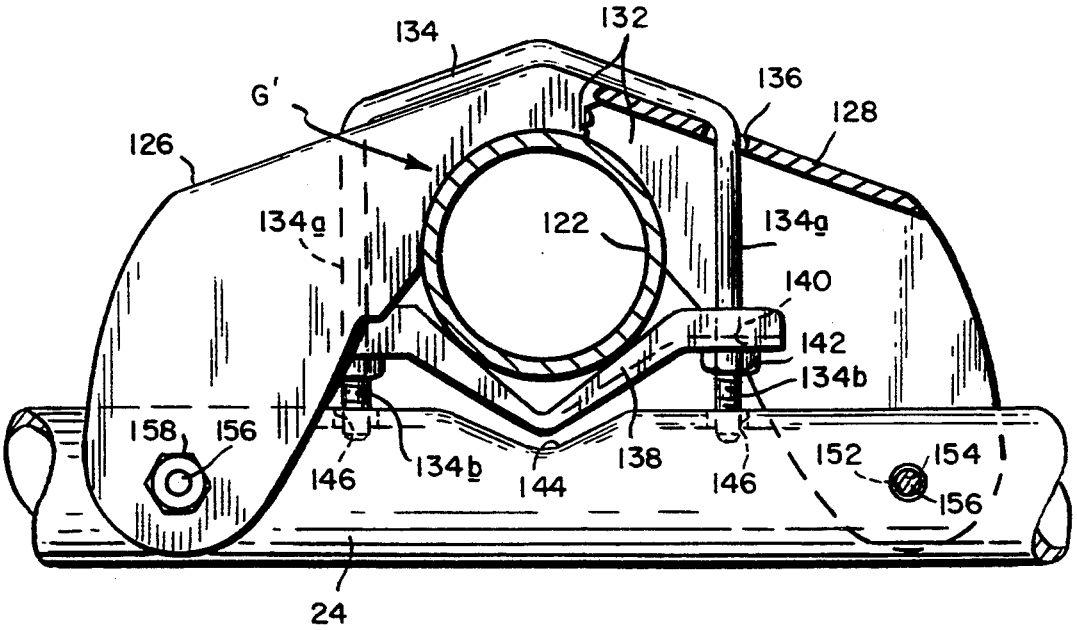
FIG. 5 is a side elevation with parts broken away showing the connection of the swing to a tubular support.

Swing 10 may also be suspended from a crossbar G' consisting of a metal tube or pipe 122 as shown in FIG. 5. In this case, the connection between each pipe 24 and the tubular crossbar 122 comprises a rigid metal saddle 126 having a top wall 128 and a pair of mirror image lobe-like side walls 132 which extend down on opposite sides of crossbar 122 well below the crossbar so that they can bracket a pipe 24 engaged crosswise against the underside of crossbar 122. Saddle 126 is secured to crossbar 122 by a heavy, generally U-shaped wire damp member 134 whose legs 134*a* extend down through openings 136 provided in the saddle top wall 128. A second mating clamp member 138 engages under crossbar 122. It has openings 140 at its opposite ends for receiving legs 134*a* and the end segments of those legs are threaded at 134*b* to receive nuts 142, which when tightened down, firmly clamp saddle 126 to crossbar 122.

As shown in FIG. 5, each pipe 24 is positioned under crossbar 122 between the two side walls of the saddle 126. A relatively large dimple or depression 144 may be formed in the upper wall of each pipe 24 to provide clearance for the clamp member 138. Also, openings 146 may be provided in the top wall of each pipe 24 to provide clearance for the threaded ends 134*b* of the clamp member 134.

Aligned holes 152 are provided in the side walls 132 of saddle 126 in each lobe of the saddle. These are arranged to align with holes 154 present in the side walls of pipe 24 so that a bolt 156 can be passed through all those holes and secured in place by a nut 158. Using this clamped saddle arrangement, there is a very strong securement of each pipe 24 to the crossbar 122 despite the fact that the engaging portions of those two members are rounded and oriented at right angles.

Figure 6A:
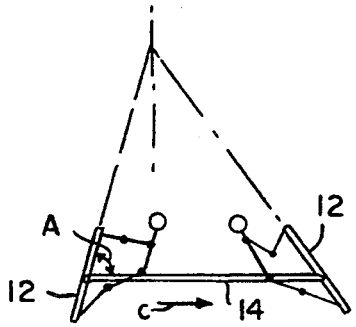
FIGS. 6A and 6B are diagrammatic views illustrating the operation of the swing.
Figure 6B:
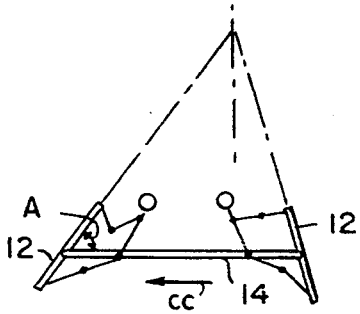

Referring now to FIGS. 6A and 6B, to use the swing, two children sit on beam 14 facing away from each other and place their hands around the grips 36 and their feet in the stirrups 42 of the rockers 12 in front of them. Then they commence rocking their respective rockers about the ends of the beam with their hands and feet. For example, if both children rotate their rockers in a counterclockwise direction as shown in FIG. 6A, the inertia caused by the leg extension of the right hand child and the leg bending of the left hand child will cause the swing to swing toward the right, or counterclockwise, as shown by the arrow C in FIG. 6A. When the swing reaches the end of its right hand swing, the two children may rotate their respective rockers in the opposite or clockwise direction. The resulting inertia caused by the leg extension of the left hand child and the leg bending of the right hand child will cause the swing to swing toward the left, or clockwise, as shown by the arrow CC in FIG. 6B. If this process is repeated at the end of each swing, the swing 10 will swing to and fro with an ever increasing amplitude. However, as the engagements of the noses **14*b* on the ends of beam 14 with the end walls of the channels 46 on the respective rockers 12** limit the pivoting motion of the rockers relative to the beam, they also limit the amplitude of the swing excursions to safeguard the children on the swing.

At any time while the swing is in motion, one or both of the children can choose to operate the swing independently by rotating a rocker 12 in the opposite direction from that of its counterpart at the opposite end of beam 14. This not only reduces the total inertia that propels the swing, it also changes the distance between the pivot rod 62 at that end of beam 14 and the pivot links 22 at the top of the swing. If, for example, the right hand child in FIG. 6A were to pivot the corresponding rocker 12 in the counterclockwise direction while the swing were moving to the right, this would lift the right hand end of the beam 14 thereby exerting a force tending to oppose the right hand or counterclockwise movement of the swing. Thus, by properly rotating the rockers 12, the two riders can exert profound influences on the swinging motion of the swing and can choose to operate cooperatively or antagonistically, depending upon their inclinations. In either event, the swing should provide a great deal of enjoyment for the children.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It should also be understood that the following claims are intended to cover all the generic and specific features of the invention described herein.

We claim:

1. A children's swing comprising an elongated rigid beam having opposite ends and means between said ends defining a seating platform for at least two children;

a pair of elongated rigid rockers, each rocker having upper and lower ends, a mid portion between the ends, hand grip means at said upper end and foot support means at said lower end;

first and second hinge means for pivotally connecting the mid portions of said rockers to the opposite ends of the beam so that each rocker can pivot about a pivot axis, the longitudinal axes of the beam and rockers being in a common plane which is perpendicular to said pivot axes;

means for confining the movement of each rocker relative to the beam substantially to movement about the pivot axis of said each rocker;

means for limiting the pivoting motion of each rocker about the corresponding pivot axis so that each rocker can swing between a first position wherein the included angle between the rocker axis and the beam is an acute angle and a second position wherein said included angle is an obtuse angle;

elongated support means spaced above the ground, said support means having a longitudinal axis;

first flexible suspension means having upper and lower ends;

first and second connection means connecting the upper and lower ends of said first suspension means to said support means and one rocker of said pair of rockers, respectively;

second flexible suspension means having upper and lower ends, and third and fourth connection means connecting the upper and lower ends of said second suspension means to said support means and the other rocker of said pair of rockers, respectively, so that said beam axis is substantially perpendicular to said support means axis, said first and third connection means being spaced apart a distance less than the spacing of said first and second hinge means, so that when said swing is at rest, the rockers and the suspension means converge toward said support means.

2. The swing defined in claim 1 wherein said angles are about 70° and about 130°, respectively.

3. The swing defined in claim 1 wherein the support means include a horizontal beam;

a pair of relatively short crossbars to which the first and third connection means are connected, and first and second mounting means mounting the respective crossbars crosswise to the beam at spaced apart locations along the beam.

4. The swing defined in claim 3 wherein the beam comprises a metal tube, and each of the first and second mounting means include a saddle member engaging over the beam, said saddle member having a pair of side walls which extend down below opposite sides of the beam and bracket the crossbar, means for clamping the saddle member to the beam, and means for fastening the crossbar to the side walls of the saddle member.

5. The swing defined in claim 1 wherein the support means also comprise a pair of A-frames supporting the opposite ends of said beam, each A-frame including a pair of diverging legs and a brace member extending between the legs of each pair of legs, and resilient sheaths covering said legs and said brace members.

6. The swing defined in claim 5 and further including rigid plastic end caps engaged on the ends of said sheaths.

7. A children's swing comprising:

an elongated rigid beam having opposite ends and means between said ends defining a seating platform for at least two children;

a pair of elongated rigid rockers, each rocker having upper and lower ends, a mid portion between the ends, hand grip means at said upper end and foot support means at said lower ends;

first and second hinge means for pivotally connecting the mid portions of said rockers to the opposite ends of the beam so that each rocker can pivot about a pivot axis, the longitudinal axes of the beam and rockers being in a common plane which is perpendicular to said pivot axes, said first and second hinge means each comprising:

a hemispherical recess in the mid portion of said rocker;

a hemispherical bulb on an end of said beam and slidably received in said recess, and a pivot pin extending through said rocker mid portion and said bulb perpendicular to the rocker axis and the beam axis, and means for confining the movement of each rocker relative to the beam substantially to movement about the pivot axis of said each rocker.

8. The swing defined in claim 7 wherein the movement confining means for each rocker include a longitudinal channel at the bottom of the recess in said each rocker and which extends perpendicular to the rocker pivot axis, and a nose protruding from the corresponding end of the beam, said nose being slidably received in said channel and having a non circular cross section so as to prevent movement of the bulb in the corresponding recess except in the direction of the channel.

* * * * *

US005393268B1

REEXAMINATION CERTIFICATE (3698th)

United States Patent [19] [11] B1 5,393,268

Cunard et al. [45] Certificate Issued Dec. 29, 1998

[54] TANDEM SWING

[75] Inventors: Joel C. Cunard; Robert J. Boudreau, both of Bedford, Pa.

[73] Assignee: Hedstrom Corporation, Bedford, Pa.

Reexamination Request:
No. 90/005,007, Jun. 3, 1998

Reexamination Certificate for:

| | |
|---|---|
| Patent No.: | **5,393,268** |
| Issued: | **Feb. 28, 1995** |
| Appl. No.: | **30,667** |
| Filed: | **Mar. 12, 1993** |

[51] Int. Cl.[6] ..... A63G 9/00
[52] U.S. Cl. ..... 472/120; 472/118
[58] Field of Search ..... 472/118–125, 111, 472/112, 108; 297/244; 403/117, 113, 112

[56] References Cited

U.S. PATENT DOCUMENTS

| | | | |
|---|---|---|---|
| D. 214,571 | 7/1969 | Cohn | D34/5 |
| D. 221,877 | 9/1971 | Richardson | D34/5 |
| D. 337,806 | 7/1993 | Nolan | D21/246 |
| 555,981 | 3/1896 | Streeter . | |
| 1,657,243 | 1/1928 | Daniels . | |
| 1,674,899 | 6/1928 | Haberman | 472/120 |
| 1,939,223 | 12/1933 | Palmer . | |
| 2,059,777 | 11/1936 | Denney | 472/124 |
| 2,609,031 | 9/1952 | Puscas . | |
| 2,823,002 | 2/1958 | Savitz . | |
| 3,503,582 | 3/1970 | Boucher . | |
| 3,596,906 | 8/1971 | Parmer . | |
| 3,682,504 | 8/1972 | Brimberg . | |
| 3,712,614 | 1/1973 | Sherman et al. | 472/118 |
| 3,754,786 | 8/1973 | Boucher et al. . | |
| 3,972,563 | 8/1976 | Gustafsson . | |
| 4,018,538 | 4/1977 | Smyrni et al. . | |
| 4,408,924 | 10/1983 | Huebner . | |
| 4,431,183 | 2/1984 | Reimann | 472/14 |
| 4,822,033 | 4/1989 | Kohus et al. . | |
| 4,856,141 | 8/1989 | Sassenberg . | |
| 4,961,558 | 10/1990 | Cunard . | |

FOREIGN PATENT DOCUMENTS

| | | |
|---|---|---|
| 6627/27 | 3/1927 | Austria . |
| 2051185 | 4/1972 | Germany . |

OTHER PUBLICATIONS

First Amended Complaint and Jury Demand of Plaintiff Hedstrom Corporation dated Apr. 13, 1998.
Answer and Counterclaim of Defendant Creative Playthings, Ltd. dated Apr. 24, 1998.
Response and Objections of Defendant Plaintif's First Set of Interrogatories dated May 8, 1998.
Reply to Counterclaim dated May 12, 1998.
Marked version of Defendant Creative Playthings' Proposed Findings of Fact and Conclusions of Law dated May 12, 1998.
Sears Catalog Fall & Winter of 1959, p. 1277 Item B.
Affidavit of Donald E. Hoffman dated May 18, 1998.
Declaration of Robert J. Boudreau in Support of Plaintiff's Motion for Preliminary Injunction, and exhibits dated Apr. 13, 1998.
Marked version of Plaintiff's Proposed Findings of Fact and Conclusions of Law in Support of Its Motion for Preliminary Injunction dated May 12, 1998.

(List continued on next page.)

*Primary Examiner*—Kien Nguyen

[57] ABSTRACT

A children's swing has an elongated beam with opposite ends and a mid portion providing a seating platform for at least two children. Pivotally attached to the opposite ends of the beam are a pair of rigid rockers, each rocker having an upper end defining hand grips and a lower end defining a foot rest. To use the rocker, the children sit on the beam back to back with their hands and feet on the hand grips and foot rests of the rockers in front of them. When the children rock the rockers in synchronism, the swing will swing to and fro with ever increasing amplitude due to the inertia of the children's limbs and changes in the included angles between the rockers and the beam.

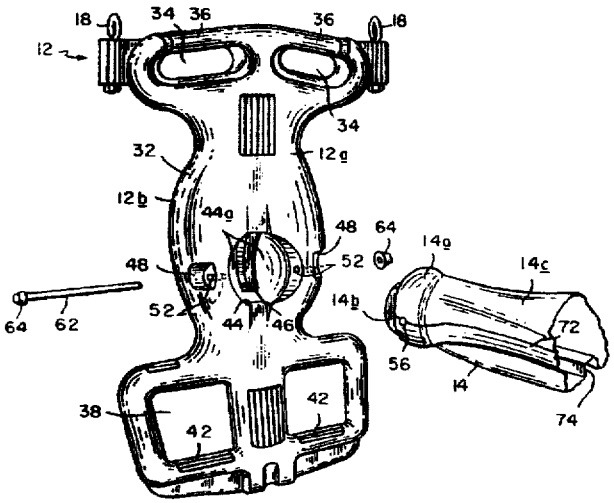

OTHER PUBLICATIONS

Marked version of Plaintiff's Proposed Additional or Substitute Findings of Fact and Conclusions of Law in Support of Its Motion for Preliminary Injunction dated May 18, 1998.

Marked version of Defendant's Proposed Addiitonal and Substitute Findings of Fact and Initial and Additional Conclusions of Law dated May 18, 1998.

Deposition of Annalee Restly, pp. 12–22.

Deposition of Donald Hoffman, pp. 58–59 and 72–75.

Deposition of Robert Boudreau, pp. 6–18, 29–42, and 45–52.

Portions of Hedstrom's 1985 Outdoor Play Equipment Catalog disclosing Hedstrom's wooden horse glider swing system.

Portions of Hedstrom's 1991 Outdoor Play Equipment Catalog disclosing Hedstrom's Ride–n–Glide swing system.

Portions of Creative's Backyard Playset Collection Catalog (circa 1977) disclosing Creative's wooden horse back–to–back swing system.

ChildLife Play Specialities, Inc., 1979, p. 3.

Court Order of May 20, 1998 denying Hedstrom's Motion for Preliminary Injunction.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *